US011287235B2

(12) United States Patent
Lafortune

(10) Patent No.: US 11,287,235 B2
(45) Date of Patent: Mar. 29, 2022

(54) ENHANCED POLYMER MARKING PROJECTILE FOR NONLETHAL CARTRIDGE

(71) Applicant: General Dynamics Ordnance and Tactical Systems—Canada, Inc., Repentigny (CA)

(72) Inventor: Eric Lafortune, Repentigny (CA)

(73) Assignee: General Dynamics Ordnance and Tactical Systems—Canada, Inc., Repentigny (CA)

( * ) Notice: Subject to any disclaimer, the term of this patent is extended or adjusted under 35 U.S.C. 154(b) by 106 days.

(21) Appl. No.: 16/795,001

(22) Filed: Feb. 19, 2020

(65) Prior Publication Data

US 2021/0270587 A1 Sep. 2, 2021

Related U.S. Application Data

(60) Provisional application No. 62/813,357, filed on Mar. 4, 2019.

(51) Int. Cl.
*F42B 12/40* (2006.01)
*F42B 14/02* (2006.01)
*F42B 14/06* (2006.01)

(52) U.S. Cl.
CPC ..... *F42B 12/40* (2013.01); *F42B 14/02* (2013.01); *F42B 14/064* (2013.01)

(58) Field of Classification Search
CPC ..... F42B 5/045; F42B 12/40; F42B 14/02; F42B 14/064
See application file for complete search history.

(56) References Cited

U.S. PATENT DOCUMENTS 5,016,536 A * 5/1991 Brighton ..... F41A 15/00 102/430
5,035,183 A 7/1991 Luxton
5,359,937 A 11/1994 Dittrich
6,575,098 B2 * 6/2003 Hsiung ..... F42B 5/02 102/498
9,157,715 B1 * 10/2015 Lafortune ..... F42B 14/02
9,476,681 B2 * 10/2016 Saxby ..... F42B 5/045
(Continued)

FOREIGN PATENT DOCUMENTS

WO 03102492 A1 12/2003
WO WO-2006111719 A1 * 10/2006 ..... F42B 8/02

*Primary Examiner* — Gabriel J. Klein
(74) *Attorney, Agent, or Firm* — LKGlobal | Lorenz & Kopf, LLP

(57) ABSTRACT

Nonlethal cartridges adapted to be chambered in a firearm having a barrel that includes rifling are provided. In one example, the cartridge includes a cartridge case and a sabot that is telescopically coupled to the cartridge case and that has a sabot mouth. A projectile includes a polymer base projectile portion disposed in the sabot mouth. A polymer front shell projectile portion is coupled to the polymer base projectile portion and has an outer surface that includes a circular locking rib feature that forms an interference fit with the sabot mouth. The polymer base projectile portion is configured to engage the rifling of the barrel to impart spin stabilization to the nonlethal projectile when propelled from the sabot in response to the expansion of a propellant gas.

20 Claims, 7 Drawing Sheets

(56) References Cited

U.S. PATENT DOCUMENTS

| | | | | |
|---|---|---|---|---|
| 2012/0192751 | A1* | 8/2012 | Lafortune | F42B 8/02 102/439 |
| 2014/0109790 | A1* | 4/2014 | Dannawi | F42B 12/34 102/502 |
| 2014/0196625 | A1* | 7/2014 | Huffman | F42B 12/36 102/444 |
| 2014/0318402 | A1* | 10/2014 | Carlson | F42B 12/76 102/439 |

* cited by examiner

ENHANCED POLYMER MARKING PROJECTILE FOR NONLETHAL CARTRIDGE

CROSS-REFERENCE TO RELATED APPLICATIONS

This application is related to and claims all available benefit of U.S. Provisional Patent Application 62/813,357 filed Mar. 4, 2019, the entire contents of which are herein incorporated by reference.

TECHNICAL FIELD

The technical field relates generally to cartridges for firearms, and more particularly, relates to cartridges including a nonlethal projectile that includes a polymer base projectile portion that is configured to engage rifling of a firearm barrel to impart spin stabilization and a polymer front shell projectile portion that is formed of a relatively soft polymer to help absorb impact energy upon impact.

BACKGROUND

Many nonlethal cartridges for firearms include a nonlethal, fully mushrooming (e.g., deforming) polymer marking projectile and have been used for realistic small caliber weapon force-on-force training for many years now. This is especially the case since the advent of U.S. Pat. No. 5,035,183, entitled "The Frangible Nonlethal Marking Projectile Design" issued to Luxton and U.S. Pat. No. 5,359,937 entitled "The Reduced Energy Cartridge" issued to Dittrich, which, when combined, revolutionized the military and law enforcement training doctrines by introducing the world to FX® marking cartridges. This industry-leading, lightweight, 2-part polymer projectile design has a front projectile shell that is filled with a color marking composition and a rear part which acts as a cap. Typically, these marking rounds have been produced for use in pistols, rifles, submachine guns and machineguns, which have been temporarily modified for training by using Simunition® weapon conversion kits.

With the emergence of such revolutionary technologies, it was now possible to conduct extremely realistic, interactive, reality-based training simulations and close quarters training exercises with and against human targets using reduced energy marking cartridges fired from a modified service weapon, without the risk of serious injury to the participants, provided they are wearing the minimum mandated protective equipment. In recent years, non-marking, full mushrooming polymer projectiles (without marking compound) have also been used, with the advantage of keeping the protective equipment and shoot house free of marking compound, to avoid the need for cleaning after training scenarios.

These FX® training cartridges feature 2-part marking projectiles that are normally filled with a semi-viscous color compound that is expelled from a thin-shelled projectile along pre-defined break lines in the front projectile portion upon impact with the target. These break lines allow the projectile to crumple upon impact and "mushroom" (e.g., deform and spread outwardly) on the target. This allows the marking compound and the impact kinetic energy of the projectile to be distributed over a larger surface area than the mere in-flight cross-sectional area of the projectile. Projectile designs with more complicated, less efficient method(s) of transferring the marking compound to the target upon impact have been developed to go around the prior art taught in U.S. Pat. No. 5,035,183 by Luxton. However, such projectiles have their own performance drawbacks. One such example is PCT Patent Application No. WO2003 GB02344-20030530 (WO3102492(A1)), which teaches a metallic marker projectile body that relies upon the forward momentum of a small ball bearing to expel the marker substance upon target impact.

Prior art nonlethal full mushrooming polymer marking projectiles often involve barrel rifling engraving into the soft polymer front shell and back part, resulting from engagement with the barrel rifling of a firearm barrel to impart spin stabilization onto the projectile. Optimal nonlethal projectile technology requires the front shell to be made of a thin and soft polymer nature with pre-defined break lines to ensure reliable and adequate projectile deformation for acceptable marking compound and energy dissipation upon impact. However, barrel engraving in soft polymer projectile natures is a notorious cause for rapid plastic fouling (e.g., generating plastic residue) of the weapon barrel, which can negatively affect the ballistic performance and reliability of the firearm and require frequent barrel cleaning.

A substantially fully mushrooming marking projectile design that engraves in the soft polymer back part and front shell can generate rapid and significant plastic fouling in the weapon barrel. As mentioned above, this requires frequent barrel cleaning to maintain constant projectile velocities and ballistic performance, which can be an irritant or a drawback for some users. Also, if not cleaned frequently, the plastic fouling residue remaining in the barrel can eventually dry out and become difficult to remove with the industry-standard bore brushing technique.

Reducing the outer diameter of the projectile front shell lower portion to minimize the contact with the barrel rifling as a means of reducing fouling is also known to compromise the projectile assembly robustness within the cartridge. The removal of material from the outside diameter bottom portion (as a means to reduce fouling) of this low strength, thin, soft shell renders it subsequently too easy to pull out or pry off the cartridge. This condition can cause the projectile front shell to become more easily dislodged from the cartridge and be misaligned or even fall out during magazine loading or firearm feeding from the magazine to the barrel chamber. Optimal ballistic performance requires that the projectile front shell remain straight and well aligned on the cartridge before firing.

In some circumstances, the marking compound in the 2-part projectile can age prematurely through prolonged exposure to sub-optimal storage (e.g., very high temperature and/or humidity) conditions and so the need for an improved shelf-life marking projectile became apparent. This is especially true for marking projectiles containing water-based color marking compounds, however, to some extent this disadvantage is offset by the significant benefit of faster, easy and complete wash-ability of the marked targets. Other concepts that employ wax or oil-based color marking compounds are not suitable for use on force training because the wax or oil-based color marking compound is difficult to clean up after training because it does not fully wash off simply with a damp cloth. Therefore, these wax or oil-based compounds induce the additional logistical burden of having to machine wash the training protective gear after the exercise.

Unfortunately, when a color marking compound containing water does age prematurely, it is possible for some of the moisture to evaporate via migration through the juncture of the 2 parts of the thin-shelled polymer projectile body. This may lead to reduced viscosity and mass of the marking compound and thus, a diminished marking effect on the intended target after time. In some cases, after storage in unfavorable conditions, the projectiles may even occasionally fail to mark, especially at very cold temperatures. As the marking compound ages, it may also be subject to a phase change and its mass distribution within the thin-walled polymer projectile may cease being uniform. This may produce a range of differing projectile moments of inertia for a given population of projectiles that were produced at the same time. Variations in the projectile moment of inertia are undesirable for exterior ballistic consistency and accuracy on the target.

Further, a loss of marking compound moisture and corresponding loss of mass may vary from projectile to projectile. This mass variation may thus lead to increased variations in projectile velocity at the muzzle of the firearm that may further lead to undesirable increased impact dispersion/spread of the marking compound on the target and decreased accuracy. The increased variation of the marking compound mass distribution inside the projectile may also lead to decreased flight stability of the lightweight polymer projectile, further degrading accuracy results. Additionally, reliable cartridge functioning in the firearm may even be affected.

Accordingly, it is desirable to provide nonlethal cartridges including nonlethal projectiles for firearms that address one or more of the foregoing concerns. Furthermore, other desirable features and characteristics of the various embodiments described herein will become apparent from the subsequent detailed description and the appended claims, taken in conjunction with the accompanying drawings and this background.

SUMMARY

Nonlethal projectiles for a nonlethal cartridge that has a mouth for holding the nonlethal projectile and nonlethal cartridges adapted to be chambered in a firearm having a barrel that includes rifling are provided herein. In an exemplary embodiment, a nonlethal cartridge includes a cartridge case. A primer and/or a propellant is disposed in the cartridge case and is ignitable to produce a propellant gas. A sabot is telescopically coupled to the cartridge case to allow relative movement between the cartridge case and the sabot in response to expansion of the propellant gas. The sabot has a sabot mouth and is configured to fluidly communicate the propellant gas to the sabot mouth. A nonlethal projectile is configured to be propelled from the sabot through the barrel of the firearm. The nonlethal projectile includes a polymer base projectile portion disposed in the sabot mouth and is formed of a first polymer material. A polymer front shell projectile portion is formed of a second polymer material that is softer than the first polymer material. The polymer front shell projectile portion is coupled to the polymer base projectile portion and has an outer surface that includes a circular locking rib feature that forms an interference fit with the sabot mouth, thereby constraining the nonlethal projectile by the sabot mouth to prevent disconnection of a projectile snap. The polymer base projectile portion is configured to engage the rifling of the barrel to impart spin stabilization to the projectile when propelled from the sabot in response to the expansion of the propellant gas. The polymer front shell projectile portion is configured to deform upon impact to absorb impact energy.

In an exemplary embodiment, a nonlethal projectile includes a polymer base projectile portion that is disposed in the mouth of the nonlethal cartridge and that is formed of a first polymer material. A polymer front shell projectile portion is formed of a second polymer material that is softer than the first polymer material. The polymer front shell projectile portion is coupled to the polymer base projectile portion and has an outer surface that includes a circular locking rib feature that forms an interference fit with the mouth. The polymer base projectile portion is configured to engage the rifling of the barrel to impart spin stabilization to the projectile when propelled through the barrel of the firearm in response to an expansion of propellant gas. The polymer front shell projectile portion is configured to deform upon impact to absorb impact energy.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following Detailed Description is merely exemplary in nature and is not intended to limit the various embodiments or the application and uses thereof. Furthermore, there is no intention to be bound by any theory presented in the preceding background or the following detailed description.

Figure 1:
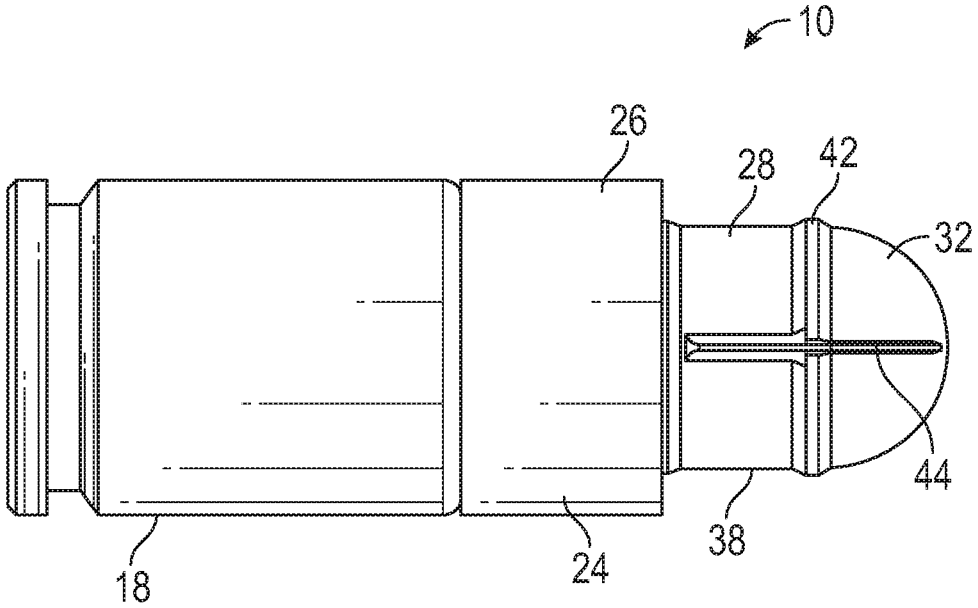
FIG. 1 illustrates a side view of a nonlethal cartridge in accordance with an exemplary embodiment.
Figure 2:
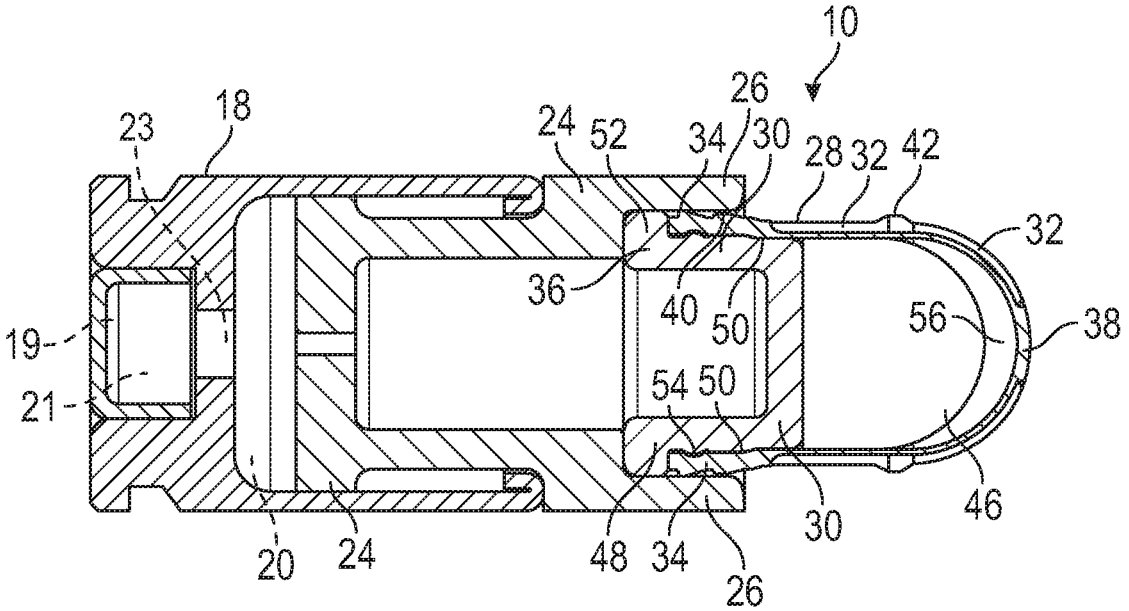
FIG. 2 illustrates a side cross-sectional view of a nonlethal cartridge in accordance with an exemplary embodiment.
Figure 3:
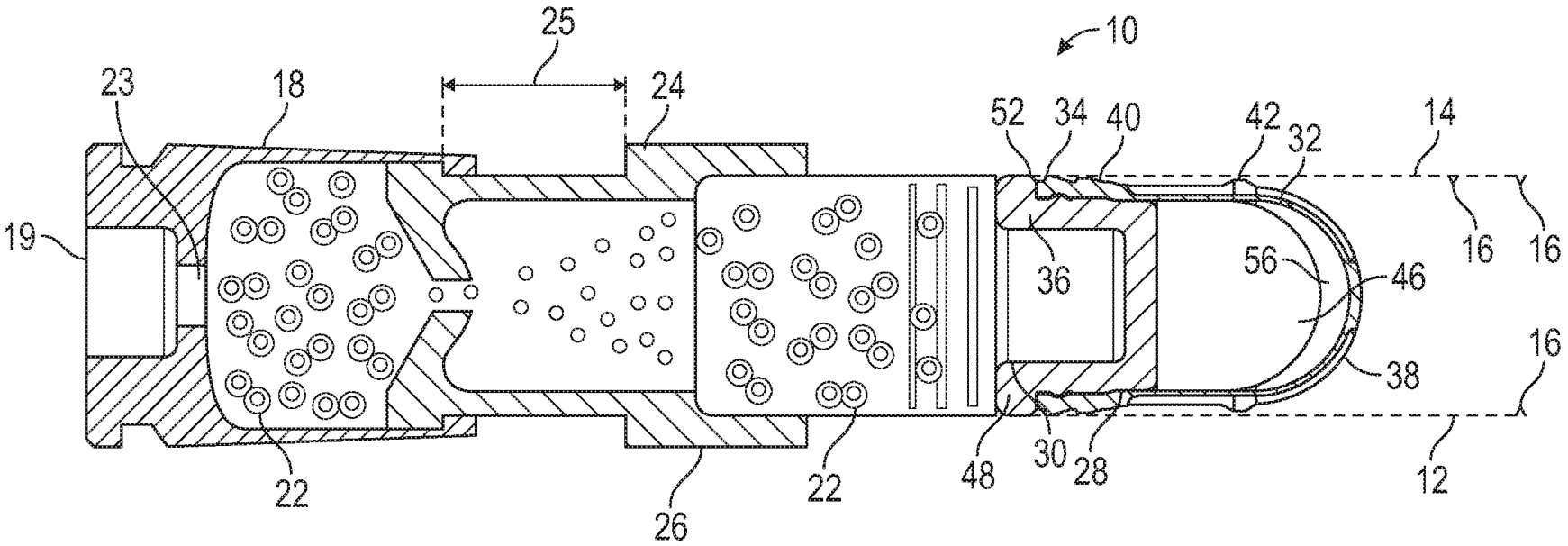
FIG. 3 illustrates a side cross-sectional view of a nonlethal cartridge during firing in a firearm in accordance with an exemplary embodiment.

Various embodiments contemplated herein relate to nonlethal cartridges including nonlethal projectiles for firearms. With reference to FIGS. 1-3, the exemplary embodiments taught herein provide a nonlethal cartridge 10 adapted to be chambered in a firearm 12 having a barrel 14 that includes rifling 16. The nonlethal cartridge 10 includes a cartridge case 18, a primer pocket 19 including a primer 21, a flash hole 23, and a propellant 20 that are disposed in the cartridge case 18. The primer 21 is ignitable to ignite the propellant 20 to produce a propellant gas 22. In an exemplary embodiment, the nonlethal cartridge 10 may include alternative configurations, such as, for example, the nonlethal cartridge 10 can be powered by a primer gas expansion alone without propellant, or alternatively powered by two primers, one for the weapon recoil and one for the projectile propulsion.

A sabot 24 is telescopically coupled to the cartridge case to allow relative movement (indicated by double headed arrow 25), for example telescopic or axial expanding/sliding movement, between the cartridge case 18 and the sabot 24 in response to expansion of the propellant gas 22. The sabot 24 has a sabot mouth 26 and is configured to fluidly communicate the propellant gas 22 to the sabot mouth 26. As illustrated, the sabot mouth 26 is sized or otherwise configured to hold a nonlethal projectile 28. In an exemplary embodiment, the nonlethal cartridge 10 may have an alternative configuration, such as, for example, a rearward recoiling inner piston in place of a sabot in which the piston includes a mouth for holding the nonlethal projectile 28.

Figure 4:
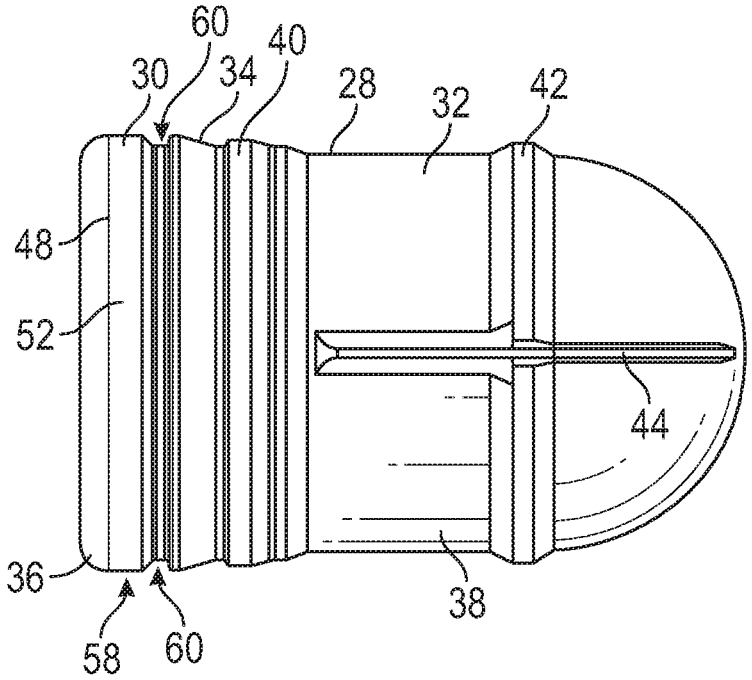
FIG. 4 illustrates a side view of a nonlethal projectile in accordance with an exemplary embodiment.
Figure 5:
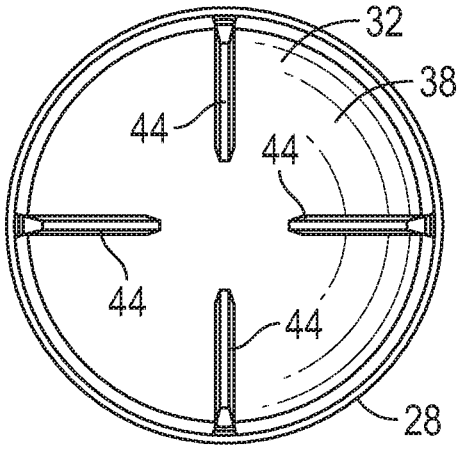
FIG. 5 illustrates a front view of a nonlethal projectile in accordance with an exemplary embodiment.
Figure 7:
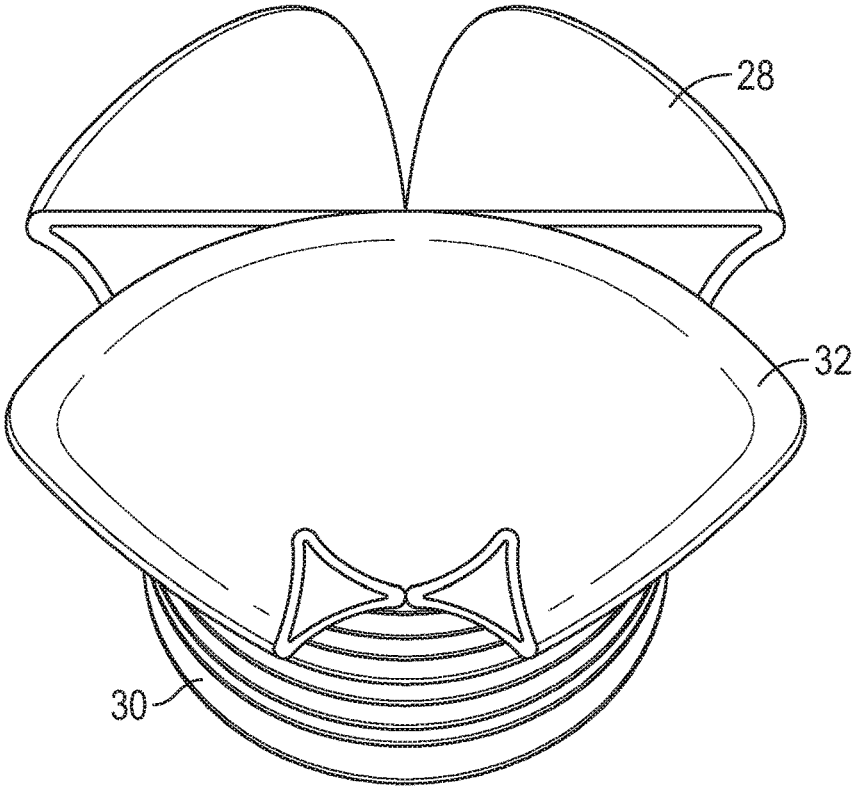
FIG. 7 illustrates a perspective view of a nonlethal projectile after impacting a target in accordance with an exemplary embodiment.
Figure 8:
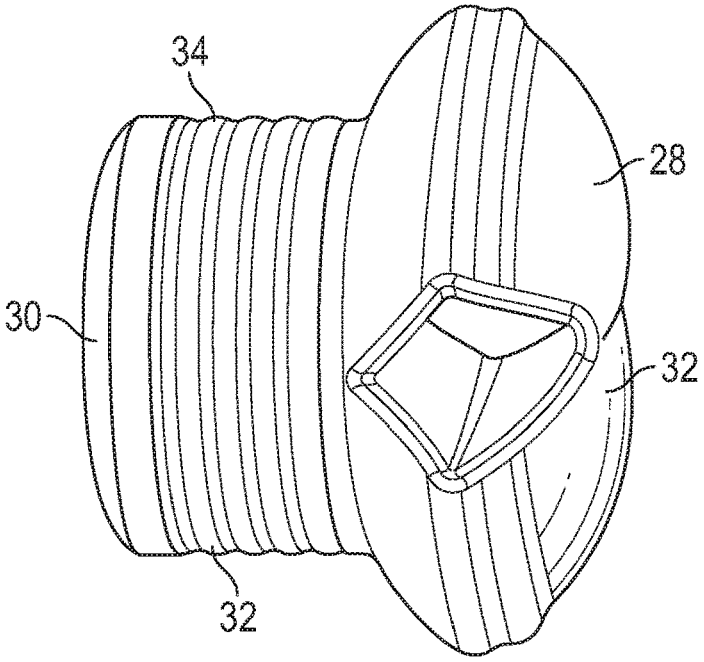
FIG. 8 illustrates a side perspective view of a nonlethal projectile after impacting a target in accordance with an exemplary embodiment.

Referring also to FIGS. 4-5, the nonlethal projectile 28 is configured to be propelled from the sabot 24 through the barrel 14 of the firearm 12 in response to expansion of the propellant gas 22. The nonlethal projectile 28 includes a polymer base projectile portion 30 that is disposed in the sabot mouth 26. A polymer front shell projectile portion 32 is coupled to the polymer base projectile portion 30. The polymer front shell projectile portion 32 has a substantially cylindrical outer surface that tapers or narrows inwardly in the forward or distal direction to define an outer surface having an aerodynamic shape with a substantially rounded front surface section. As illustrated, on the rearward section of the polymer front shell projectile portion 32, the outer surface includes a circular locking rib feature 34 (e.g., annular locking rib feature) that forms an interference fit with the sabot mouth 26. The polymer base projectile portion 30 is configured to engage the rifling 16 of the barrel 14 to impart spin stabilization to the nonlethal projectile 28 when propelled from the sabot 24 in response to the expansion of the propellant gas 22 during firing of the firearm 12. As illustrated in FIGS. 7-8, the polymer front shell projectile portion 32 is configured to mushroom or otherwise deform upon impact to absorb impact energy, for example when the nonlethal projectile 28 hits an intended target.

Referring again to FIGS. 1-5, in an exemplary embodiment, the nonlethal projectile 28 is relatively lightweight as compared to other conventional nonlethal projectiles. Further, the polymer base projectile portion 30 is formed of a relatively hard or rigid polymer material 36 and the polymer front shell projectile portion 32 is formed of a relatively soft or flexible polymer material 38 that is softer than the relatively hard polymer material 36 of the polymer base projectile portion 30. As discussed above, the polymer base projectile portion 30, which is disposed on the back part of the nonlethal projectile 28 rearward of the polymer front shell projectile portion 32, is dimensioned or otherwise sized to engage the rifling 16 to impart spin to the nonlethal projectile 28, and further to obturate the propellant gas 22 and to scrape, collect and remove any combustion and polymer residues that may have been deposited in the barrel 14 and/or rifling 16.

Figure 9:
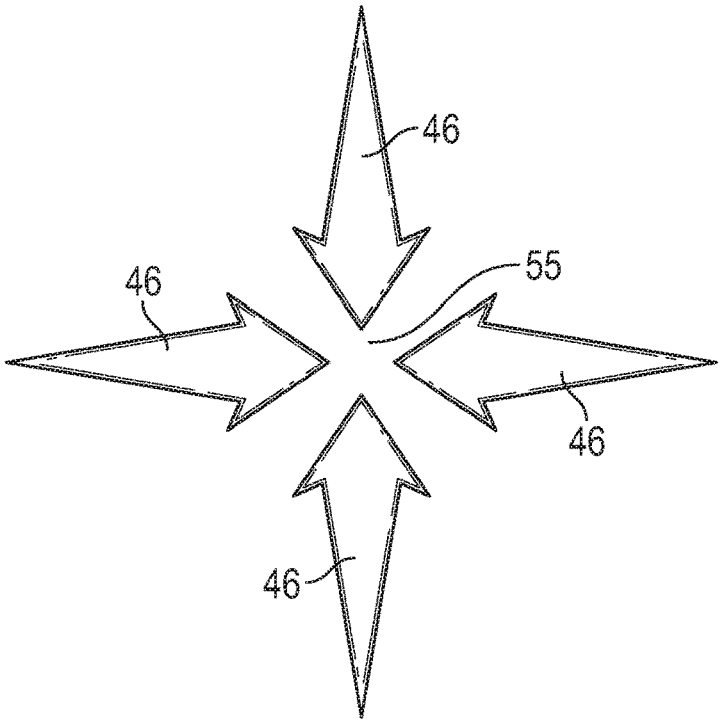
FIG. 9 illustrates a perspective side view of a marking compound pattern from a nonlethal projectile after impacting the target in accordance with an exemplary embodiment.

As illustrated, in an exemplary embodiment, the outer surface of the polymer front shell projectile portion 32 includes two annular or circular guiding bands 40 and 42 for optimal engraving alignment in the barrel 14 and includes pre-positioned break lines (frangible lines) 44 to enable substantially complete mushrooming (shown in FIGS. 7-8) on the target 55 to consistently release the marking compound 46 (see also FIG. 9) and distribute the impact energy.

As will be discussed in further detail below, the polymer base projectile portion 30 has a perimeter base end portion 48 that extends from the outer base surface 50 and that defines a rear driving band 52. In an exemplary embodiment, advantageously the rear driving band 52 of the polymer base projectile portion 30 and the circular locking rib feature 34 and the circular guiding bands 40 and 42 of the polymer front shell projectile portion 32 cooperate to enable effective magazine loading and feeding robustness in firearms 12 and to aid in transferring spin from the polymer base projectile portion 30 to the polymer front shell projectile portion 32 when the nonlethal projectile 28 is accelerated through the barrel 14 engaging with the rifling 16.

In an exemplary embodiment, the outer base surface 50 of the polymer base projectile portion 30 includes a circular projectile snap feature 54 that is configured to attach the polymer base projectile portion 30 and the polymer front shell projectile portion 32. This embodiment also includes an interference or "press fit" between the diameters of outer base surface 50 of polymer base projectile portion 30 and the contacting diameter polymer front shell projectile portion 32 which aids in sealing the marking compound 46 that is disposed in the internal shell volume 56 of the nonlethal projectile 28 to extend the shelf life of the marking compound 46 and thus of the nonlethal projectile 28. In an alternative embodiment, the nonlethal projectile 28 is a non-marking nonlethal projectile in which the internal shell volume 56 of the nonlethal projectile does not contain any marking compound and therefore, is a relatively lighter weight nonlethal projectile.

In an exemplary embodiment, the polymer front shell projectile portion 32 has a shell length, and the polymer base projectile portion 30 is disposed in the internal shell volume 56 a distance of at least about 30% of the shell length, while the perimeter base end portion 48 is disposed rearward of the polymer front shell projectile portion 32 outside of the internal shell volume 56. Advantageously, the insertion depth of the polymer base projectile portion 30 into the internal shell volume 56 represents an increase of approximately 15% compared to the prior art nonlethal projectiles, thereby, once the nonlethal projectile 28 is assembled in the sabot 24, increasing the resistance to possibly prying off the relatively soft, thin and fragile polymer front shell projectile portion 32 from the polymer base projectile portion 30 held within the mouth 26 of the sabot 24.

In an exemplary embodiment, once the nonlethal projectile 28 is assemble in the sabot 24, advantageously the circular locking rib feature 34 of the polymer front shell projectile portion 32, effectively acts as a restriction with the sabot mouth 26 to prevent the projectile snap attachment 54 from disconnecting and thus increasing the resistance to possibly pulling out the polymer front shell projectile portion 32 from the polymer base projectile portion 30 held within the sabot mouth 26 (e.g., ensuring the projectile snap connection is maintained). This key feature also aids in ensuring full spin transfer from the polymer base projectile portion 30 to the polymer front shell projectile portion 32 through the compressive forces from the rifling 16 to the circular locking rib feature 34 to the polymer base projectile portion 30. The circular locking rib feature 34 of the polymer front shell projectile portion 32 is configured to ensure the projectile snap connection 54 is maintained while having a minimal contact surface area with the rifling 16 to ensure negligible soft plastic barrel fouling. In an exemplary embodiment, the circular locking rib feature 34 has a profile shape such as a square shape, a rectangle shape, an arcuate shape, a radius, a cone shape, the like, or a combination thereof, for example a rectangle shape combined with a conical leading edge to ensure minimal, but sufficient surface contact with the rifling 16 of the barrel 14 of the firearm 12. In an exemplary embodiment, the rectangular shape portion of the circular locking rib feature 34 is positioned slightly behind (e.g., rearward) the projectile snap feature 54 to ensure effective resistance to the projectile snap disconnection.

In an exemplary embodiment, advantageously the rear driving band 52 of the polymer base projectile portion 30 is configured to efficiently scrape and collect any combustion or polymer residues that may be deposited in the barrel 14, by combining the rigidity from the hard polymer material 36 and the relatively sharp leading-edge 58 geometry of the rear driving band 52. In an exemplary embodiment, advantageously, residues are effectively collected in a gap 60 formed between the rear driving band 52 and the circular locking rib feature 34.

Figure 6A:
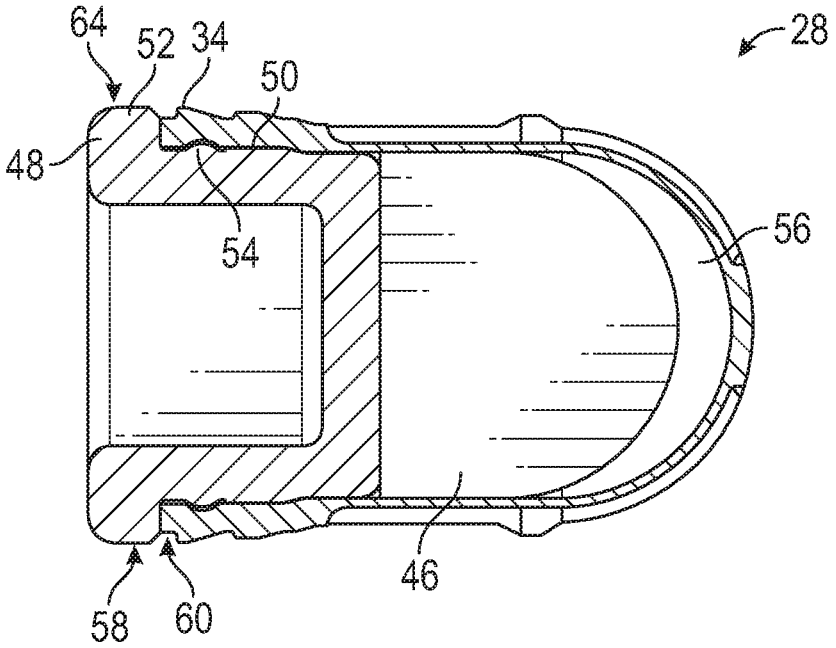
FIG. 6A illustrates a side cross-sectional view of a nonlethal projectile in accordance with an exemplary embodiment.
Figure 6B:
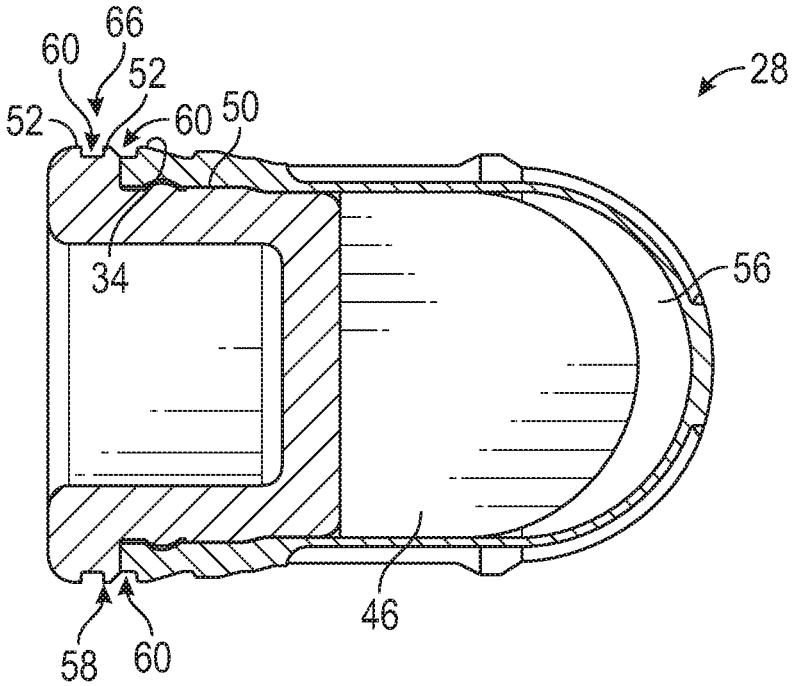
FIG. 6B illustrates a side cross-sectional view of a nonlethal projectile in accordance with an exemplary embodiment.
Figure 6C:
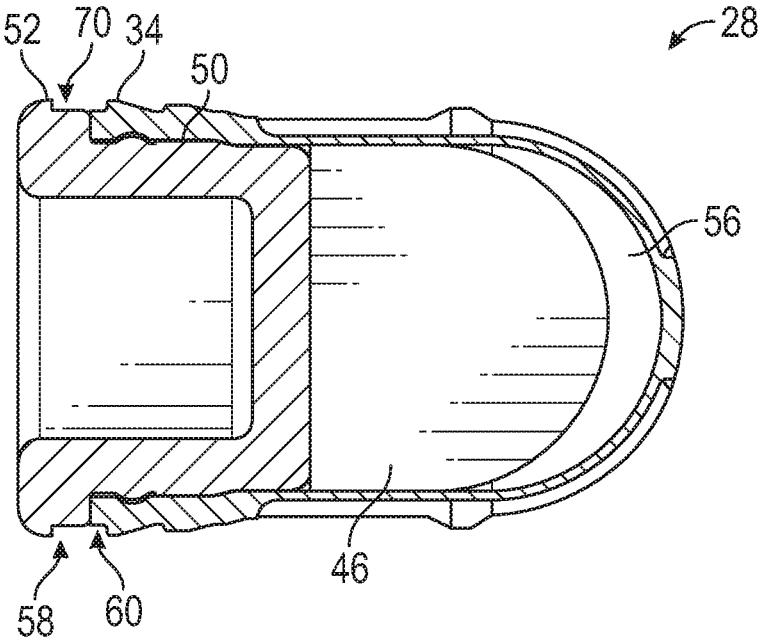
FIG. 6C illustrates a side cross-sectional view of a nonlethal projectile in accordance with an exemplary embodiment.
Figure 6D:
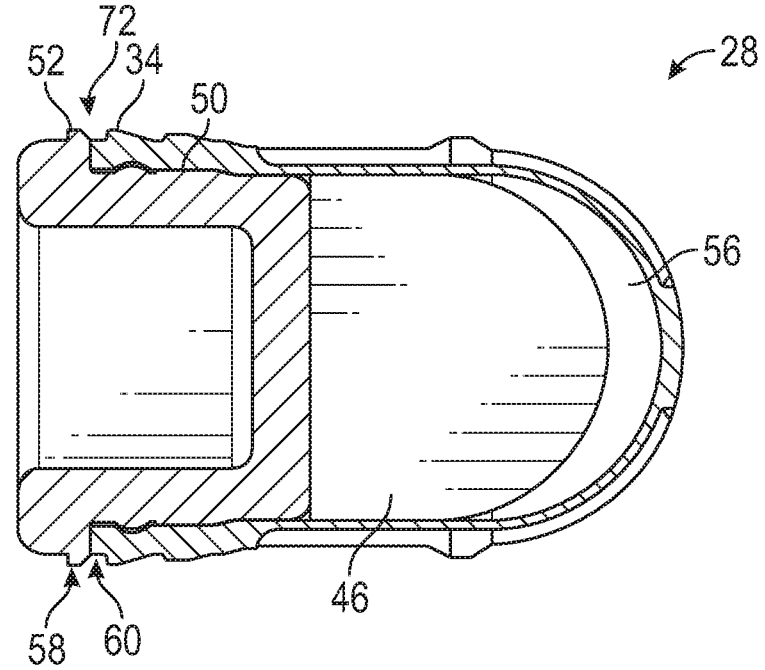
FIG. 6D illustrates a side cross-sectional view of a nonlethal projectile in accordance with an exemplary embodiment.

Referring to FIGS. 6A-6D the rear driving band 52 of the polymer base projectile portion 30 may have various configurations. In an exemplary embodiment and as illustrated in FIG. 6A, the rear driving band 52 is configured as a rear, substantially full-length driving band 64. In another exemplary embodiment and as illustrated in FIG. 6B, the rear driving band 52 is configured as a rear, grooved driving band 66 which includes two gaps and two sharp leading-edge features which can mutually act to scrape and collect residues. In another exemplary embodiment and as illustrated in FIG. 6C, the rear driving band 52 is configured as a rear, rear edged driving band 70. In another exemplary embodiment and as illustrated in FIG. 6D, the rear driving band 52 is configured as a rear, forward edged driving band 72.

Figure 10:
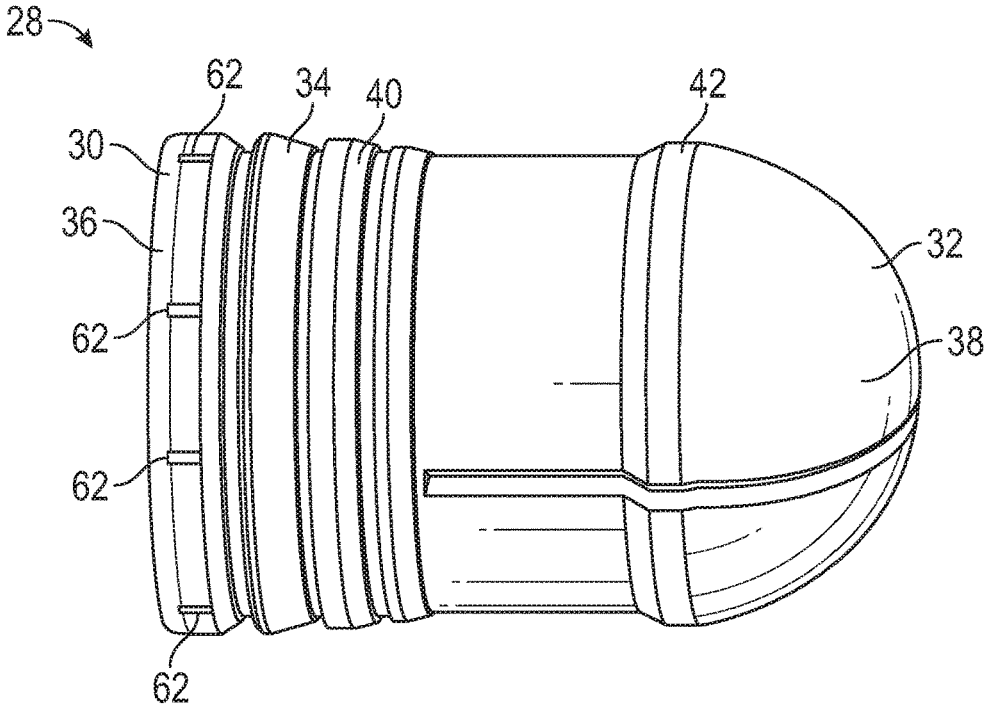
FIG. 10 illustrates a side view of a nonlethal projectile that has been engraved from rifling after traveling through a barrel of a firearm.

As illustrated in FIG. 10, in an exemplary embodiment, the hard polymer material 36 of the polymer base projectile portion 30 in combination with the rear driving band 52 results in a much smaller engraving surface 62, thereby reducing plastic fouling which may be deposited by the softer polymer front shell projectile portion 32 during weapon firing. In an exemplary embodiment, advantageously the nonlethal projectile 28 significantly reduces plastic fouling in the barrel 14. With the elimination of undesired plastic barrel fouling, muzzle velocity and spin transfer consistency is greatly improved, thus improving accuracy on the target 55 and reducing target impact dispersion, thereby enabling the user to maintain the expected ballistic performance and projectiles velocity with a minimal barrel cleaning frequency.

A variety of rigid grade polymers can be used to form the polymer base projectile portion 30, such as, for example, polyamide (e.g., nylon(s)), high density polyethylene, PVC blends, acetal polymers (e.g., Delrin®), or the like. In an exemplary embodiment, the hard polymer material 36 includes acetal homopolymer, acetal copolymer, or a combination thereof to provide adequate engraving resistance, excellent dimensional stability, relatively high melting point and low barrel fouling characteristics. In an exemplary embodiment, the soft polymer material 38 that forms the polymer front shell projectile portion 32 is a relatively flexible polymer, such as a flexible grade of polyolefin, for example polypropylene and/or a thermoplastic olefin (TPO).

In an exemplary embodiment, the hard polymer material 36 of the polymer base projectile portion 30 has a hardness of at least 100 Rockwell R, for example a hardness of from about 100 to about 140 Rockwell R. In an exemplary embodiment, the soft polymer material 38 of the polymer front shell projectile portion 32 has a Shore D hardness of from about 35 to about 65, such as from about 40 to about 60, such as from about 40 to about 50, for example about 46.

As discussed above, the polymer front shell projectile portion 32 has at least one, for example at least two circular guiding bands 40 and 42, that are integrally molded in the polymer front shell projectile portion 32. In an exemplary embodiment, the circular guiding bands 40 and 42 are slightly smaller (e.g. smaller outside diameter) than the barrel 14 bore diameter to advantageously guide the nonlethal projectile 28 in the barrel 14 bore to minimize balloting within the barrel 14 (to minimize projectile yaw upon leaving the barrel 14) and to contribute to improving the accuracy of the nonlethal projectile 28, thereby improving the nonlethal projectile's accuracy to longer ranges than the prior art projectile configurations.

In an exemplary embodiment, the nonlethal projectile 28 is configured for use in various caliber weapons. In one example, the nonlethal projectile 28 is about a 5.56 mm caliber projectile and has a weight of from about 0.15 to about 0.4 grams. In another example, the nonlethal projectile 28 is about a 6.8 mm caliber projectile and has a weight of from about 0.2 to about 0.5 grams. In yet another example, the nonlethal projectile 28 is about a 7.62 mm caliber projectile and has a weight of from about 0.2 to about 0.6 grams. In another example, the nonlethal projectile 28 is about a 9 mm caliber projectile and has a weight of from about 0.3 to about 0.7 grams.

EXAMPLE

The following is a nonlimiting example of a nonlethal projectile in accordance with an exemplary embodiment. The nonlethal projectile 28 is configured as a subcaliber 7.62 mm projectile with the following average specs:

Barrel rifling bore diameter: Ø0.300 inches.

Barrel rifling groove diameter: Ø0.308 inches.

Projectile engraving diameter on the rear driving band: Ø0.308 inches.

Circular locking rib feature, diameter: Ø0.306 inches.

Sabot mouth diameter: Ø0.306 inches

Circular guiding band(s), diameter(s): Slightly≤Ø0.300 inches.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A nonlethal cartridge adapted to be chambered in a firearm having a barrel that includes rifling, the nonlethal cartridge comprising:

a cartridge case;

a primer and/or a propellant disposed in the cartridge case and ignitable to produce a propellant gas;

a sabot telescopically coupled to the cartridge case to allow relative movement between the cartridge case and the sabot in response to expansion of the propellant gas, wherein the sabot has a sabot mouth and is configured to fluidly communicate the propellant gas to the sabot mouth; and a nonlethal projectile configured to be propelled from the sabot through the barrel of the firearm, the nonlethal projectile comprising:

a polymer base projectile portion disposed in the sabot mouth and formed of a first polymer material; and a polymer front shell projectile portion formed of a second polymer material that is softer than the first polymer material, the polymer front shell projectile portion coupled to the polymer base projectile portion and including an outer surface having a circular locking rib feature formed thereon that provides an interference fit with the sabot mouth, thereby constraining the nonlethal projectile by the sabot mouth to prevent disconnection of a projectile snap, wherein the polymer base projectile portion is configured to engage the rifling of the barrel to impart spin stabilization to the nonlethal projectile when propelled from the sabot in response to the expansion of the propellant gas and the polymer front shell projectile portion is configured to deform upon impact to absorb impact energy.

2. The nonlethal cartridge of claim 1, wherein the polymer base projectile portion is configured to engage the rifling of the barrel to remove combustion and/or polymer residues.

3. The nonlethal cartridge of claim 1, wherein the circular locking rib feature has a profile shape selected from the group consisting of a square shape, a rectangle shape, an arcuate shape, a radius, a cone shape, or a combination thereof.

4. The nonlethal cartridge of claim 1, wherein the polymer front shell projectile portion comprises a shell wall that surrounds an internal shell volume, and wherein the shell wall has the outer surface and an inner surface that is opposite the outer surface and that is facing the internal shell volume, and wherein the polymer base projectile portion has a base wall that surrounds an internal base volume, and wherein the base wall has an outer base surface that interfaces with the inner surface of the shell wall.

5. The nonlethal cartridge of claim 4, wherein the outer base surface includes a projectile snap feature that engages the inner surface of the shell wall.

6. The nonlethal cartridge of claim 5, wherein the circular locking rib feature is positioned substantially axially aligned with the projectile snap feature.

7. The nonlethal cartridge of claim 4, wherein the shell wall has a perimeter shell end portion, and the polymer base projectile portion has a perimeter base end portion that extends from the outer base surface and that defines a rear driving band, and wherein the perimeter shell end portion is disposed forward and adjacent to the perimeter base end portion, and the perimeter base end portion is sized to engage the rifling of the barrel.

8. The nonlethal cartridge of claim 7, wherein the rear driving band is a rear, substantially full-length driving band.

9. The nonlethal cartridge of claim 7, wherein the rear driving band is a rear, grooved driving band.

10. The nonlethal cartridge of claim 7, wherein the rear driving band is a rear, rear edged driving band.

11. The nonlethal cartridge of claim 7, wherein the rear driving band is a rear, forward edged driving band.

12. The nonlethal cartridge of claim 7, wherein the perimeter base end portion defines an outer base end diameter and the circular locking rib feature defines an outer circular rib diameter that is substantially the same as the outer base end diameter.

13. The nonlethal cartridge of claim 7, wherein the circular locking rib feature is spaced apart from the rear driving band to define a gap.

14. The nonlethal cartridge of claim 7, wherein the polymer front shell projectile portion has a shell length, and the polymer base projectile portion is disposed in the internal shell volume a distance of at least about 30% of the shell length, and the perimeter base end portion is disposed rearward of the polymer front shell projectile portion outside of the internal shell volume.

15. The nonlethal cartridge of claim 7, wherein the rear driving band has a leading-edge configured to facilitate removing combustion and/or polymer residues from the barrel while the nonlethal projectile is propelled therethrough.

16. The nonlethal cartridge of claim 4, wherein the shell wall defines a plurality of frangible lines configured to rupture upon impact to facilitate deformation of the polymer front shell projectile portion to absorb impact energy.

17. The nonlethal cartridge of claim 4, wherein the nonlethal projectile further comprises a marking compound that is disposed in the internal shell volume.

18. The nonlethal cartridge of claim 4, wherein the internal shell volume does not contain any marking compound.

19. The nonlethal cartridge of claim 1, wherein the outer surface of the polymer front shell projectile portion includes at least one circular guiding band configured to help aligned the nonlethal projectile traveling through the barrel against the rifling.

20. A nonlethal projectile for a nonlethal cartridge that has a mouth for holding the nonlethal projectile and that is adapted to be chambered in a firearm having a barrel that includes rifling, the nonlethal projectile comprising:

a polymer base projectile portion disposed in the mouth and formed of a first polymer material; and a polymer front shell projectile portion formed of a second polymer material that is softer than the first polymer material, the polymer front shell projectile portion coupled to the polymer base projectile portion and including an outer surface having a circular locking rib feature formed thereon that provides an interference fit with the mouth, wherein the polymer base projectile portion is configured to engage the rifling of the barrel to impart spin stabilization to the nonlethal projectile when propelled through the barrel of the firearm in response to an expansion of propellant gas and the polymer front shell projectile portion is configured to deform upon impact to absorb impact energy.

* * * * *